US006982392B1

(12) United States Patent
Burger

(10) Patent No.: US 6,982,392 B1
(45) Date of Patent: Jan. 3, 2006

(54) WATER RESISTANT ACTUATING MECHANISM FOR PLUNGER TYPE SWITCHES

(75) Inventor: Philip M. Burger, Olathe, KS (US)

(73) Assignee: Burger & Brown Engineering, Inc.

( * ) Notice: Subject to any disclaimer, the term of this patent is extended or adjusted under 35 U.S.C. 154(b) by 0 days.

(21) Appl. No.: 11/124,489

(22) Filed: May 6, 2005

(51) Int. Cl.
*H01H 9/04* (2006.01)

(52) U.S. Cl. ..... 200/302.1; 200/302.2; 200/523; 200/342

(58) Field of Classification Search ..... 200/302.1, 200/302.2, 449, 453, 537, 341–342, 523, 200/329
See application file for complete search history.

(56) References Cited

U.S. PATENT DOCUMENTS

| | | | | |
|---|---|---|---|---|
| 2,673,468 | A | | 3/1954 | Immel et al. |
| 2,679,559 | A | | 5/1954 | Morris et al. |
| 2,888,731 | A | | 6/1959 | McElroy et al. |
| 3,094,591 | A | | 6/1963 | Hill |
| 3,099,736 | A | | 7/1963 | Willcox |
| 3,566,065 | A | | 2/1971 | Davis |
| 3,594,529 | A | | 7/1971 | Cartwright |
| 3,647,309 | A | | 3/1972 | Thompson |
| 3,825,809 | A | | 7/1974 | Gatland |
| 3,836,300 | A | | 9/1974 | Farrell |
| 4,295,017 | A | | 10/1981 | Kashima et al. |
| 4,307,271 | A | | 12/1981 | Carli |
| 4,488,024 | A | | 12/1984 | Colgate |
| 4,536,625 | A | * | 8/1985 | Bebie ..... 200/5 A |
| 4,619,271 | A | | 10/1986 | Burger et al. |
| 4,652,706 | A | * | 3/1987 | Rao et al. ..... 200/409 |
| 5,168,982 | A | | 12/1992 | Hakanen et al. |
| 5,343,008 | A | * | 8/1994 | Ipcinski ..... 200/302.2 |
| 5,446,252 | A | | 8/1995 | Burger et al. |
| 5,660,272 | A | * | 8/1997 | Janniere et al. ..... 200/517 |
| 5,726,400 | A | * | 3/1998 | Masuda ..... 200/16 D |
| 6,621,446 | B1 | * | 9/2003 | Chaillie ..... 341/176 |
| 6,734,381 | B2 | | 5/2004 | Mayo |

FOREIGN PATENT DOCUMENTS

| | | |
|---|---|---|
| GB | 829965 | 3/1960 |
| SU | 1594621 A1 | 9/1990 |

* cited by examiner

*Primary Examiner*—Kyung Lee
(74) *Attorney, Agent, or Firm*—Erickson & Kleypas, L.L.C.

(57) ABSTRACT

A water resistant actuating mechanism for a plunger type limit switch using a bowed spring to activate the plunger of a plunger type switch mounted within an actuating mechanism housing includes a flexible seal for covering the hole or opening in through which the bowed spring extends. The seal may be dome shaped and cover a circular opening. A glide or shoe is positioned on or connected to each end of the spring and are held in place between an upper wall of the housing and a backing sheet connected to the housing. The glide reduces the amount of deflection of the bowed spring required to activate the plunger type switch such that the additional thickness added by the flexible seal does not increase the overall required thickness of the actuating mechanism.

20 Claims, 2 Drawing Sheets

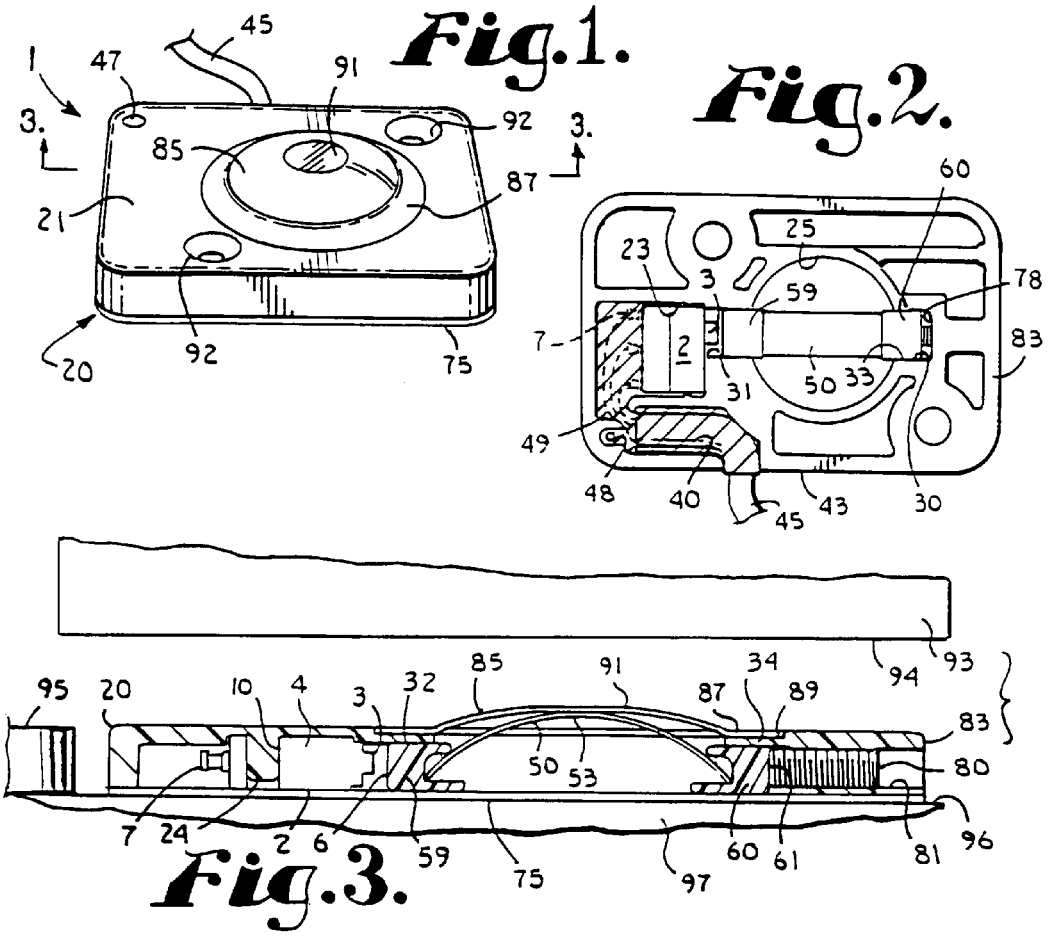
Fig.4.
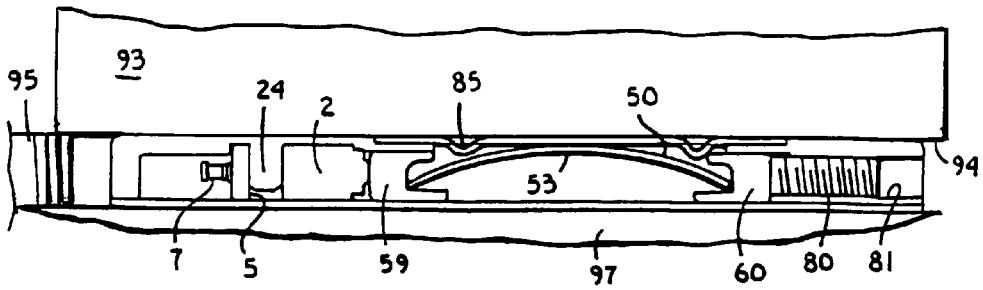

WATER RESISTANT ACTUATING MECHANISM FOR PLUNGER TYPE SWITCHES

BACKGROUND OF THE INVENTION

The present invention relates to improvements in actuating mechanisms for plunger type switches, and more specifically improvements which make the mechanism water resistant.

U.S. Pat. No. 5,446,252, issued Aug. 29, 1995, discloses an actuating mechanism for a plunger type switch which is particularly well adapted for use as a limit switch or proximity sensor and which may be positioned in relatively narrow spaces. The length of a plunger-type switch (the dimension of the switch extending along the axis of the plunger) is generally considerably greater than the thickness of the plunger-type switch. Therefore, to ensure minimum thickness of the limit switch, the actuating mechanism should translate a force applied perpendicular to the axis of the plunger to a force directed coaxially with the plunger.

In the actuating mechanism disclosed in U.S. Pat. No. 5,446,252, a bowed length of spring steel is used to translate a force directed perpendicular to the axis of the switch plunger to a force directed coaxially with the plunger. The bowed spring is secured within a housing along with the plunger-type switch such that a first end of the spring is spaced in close proximity to or in engagement with the plunger in the extended position. A middle or bowed portion of the spring extends above an upper surface of the housing through an opening or slot. The second end of the spring abuts against the housing (or a set screw) at an end of the opening or slot opposite the first spring end. Ends of the spring are turned upward to form feet for engaging the plunger or the housing or a set screw extending through the housing.

Application of an external force to the middle or bowed portion of the spring directed towards the upper surface of the housing changes the position of the plunger and more specifically advances the first spring end toward the switch a distance sufficient to move the plunger to the retracted position. Upon removal of the external force, the spring returns to its original bowed state such that the first end of the spring advances away from the switch and the plunger is allowed to move to the extended position.

Although the actuating mechanism works well for its intended purpose of providing a limit switch positionable in relatively narrow spaces, there remain needs for improvements to the actuating mechanism to increase its life. For example, there remains a need for such a switch actuator which resists migration of water or other liquids through the housing and into the plunger type switch and electrical connections, without unnecessarily increasing the thickness of the actuating mechanism.

SUMMARY OF THE INVENTION

The present invention comprises an improved version of the actuating mechanism for a plunger-type switch as disclosed in U.S. Pat. No. 5,446,252. The actuating mechanism is particularly well adapted for actuating plunger-type switches having relatively small dimensions such as the B3-32131 sub miniature basic switch manufactured by Otto Engineering, Inc. The actuating mechanism disclosed in U.S. Pat. No. 5,446,252 comprises a bowed flat-type spring mounted in a housing for the plunger-type switch with one leg of the spring engaging and depressing the plunger when the bowed spring is compressed upon the application of a force perpendicular to the axis of the switch plunger. The bowed portion of the spring extends through an opening or slot in the housing and a backing sheet holds the spring and the switch in the housing.

In the improved actuating mechanism a flexible seal is connected to an upper surface of the housing and encloses and forms a seal around the spring and the spring opening in the housing. In a preferred embodiment the opening for the spring is circular and the seal is semi-spherical. A glide or shoe is positioned on or connected to each end of the spring and are held in place between the upper wall of the housing and the backing sheet connected to the housing. As with the upturned feet of the previously disclosed flat spring actuating mechanism, one of the glides is positioned proximate the outer end of the plunger of the plunger-type switch and the other glide is positioned proximate an opposite inner wall of the housing or proximate a set screw extending through the inner wall. The set screw (which is not shown in U.S. Pat. No. 5,446,252) is used to adjust the overall amount of compression of the bowed spring to cause the opposite end of the spring to fully depress the plunger and change the switch condition.

The glides are designed to result in a more efficient translation of the distance which the bowed spring is compressed to the distance traveled by the outer surface of the glide thereby reducing the overall height required for the bowed portion of the spring to extend above the upper surface of the housing.

Reducing the height that the bowed portion must extend above the housing upper surface to result in the necessary travel of the spring ends to actuate or change the condition of the switch is particularly helpful in accommodating for any added height resulting from the addition of the seal.

Water-proof or water resistant potting compound may be applied around the wiring of the switch in channels or cavities formed in the housing for receiving the switch and associated wiring to further seal the wiring from water infiltration. Similarly a sealing compound may be applied to the threads of the set screw in the housing to prevent migration of water between the screw and the housing.

BRIEF DESCRIPTION OF THE DRAWINGS

FIG. 1 is a perspective view of a limit switch actuating mechanism for a plunger-type switch.

FIG. 2 is a bottom plan view of the limit switch actuating mechanism with a backing sheet removed to show detail thereof.

FIG. 3 is a cross-sectional view generally taken generally along line 3—3 of FIG. 1 and showing the limit switch actuating mechanism secured within an ejector plate assembly of an injection mold with the ejector plate in an extended position.

FIG. 4 is a view similar to FIG. 3 showing the ejector plate advanced into engaging relation with the actuating mechanism showing compression of a bowed spring of the actuating mechanism with glides on ends thereof to actuate the limit switch.

DETAILED DESCRIPTION OF THE PREFERRED EMBODIMENT

Figure 5:
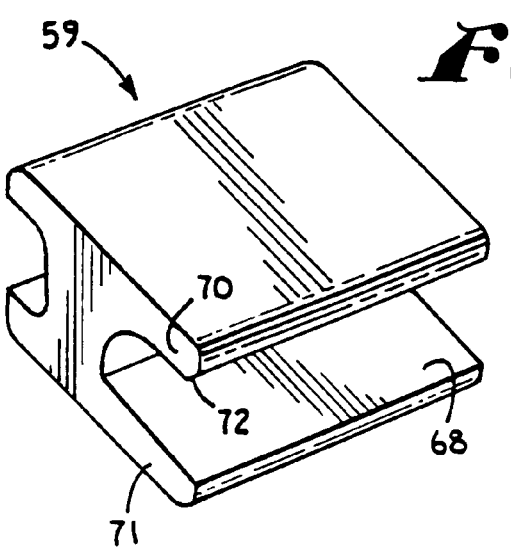
FIG. 5 is an enlarged perspective view of a glide of the actuating mechanism.
Figure 6:
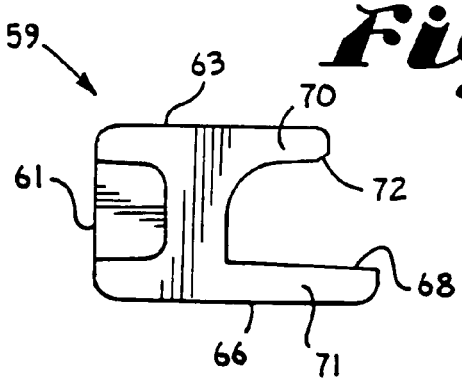
FIG. 6 is a left side elevational view of the glide as shown in FIG. 5.
Figure 7:
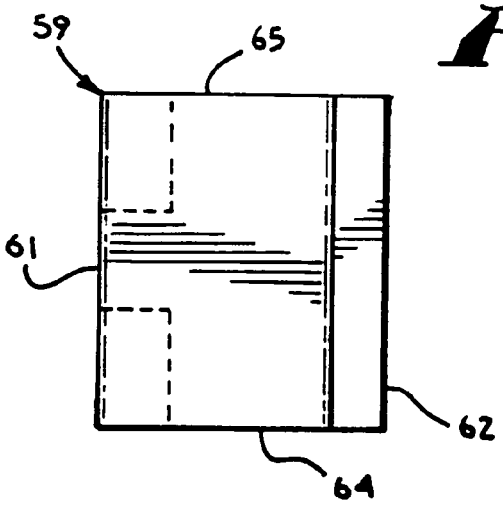
FIG. 7 is a top plan view of the glide as shown in FIG. 5.

As required, detailed embodiments of the present invention are disclosed herein; however, it is to be understood that the disclosed embodiments are merely exemplary of the invention, which may be embodied in various forms. Therefore specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 refers to an actuating mechanism for a plunger-type switch 2. The actuating mechanism 1, including switch 2 may also be referred to as a switch or limit switch. The plunger-type switch 2, as best seen in FIG. 2, is a plunger actuated type switch having a plunger 3 projecting from a switch casing 4, such as the B3-32131 switch discussed above. The switch 2 operates with a snap action upon axial movement of the plunger 3 through a given distance between an extended position to a retracted position. The plunger 3 is normally biased to the extended position. Securement holes 5 extend through the switch casing 4 to facilitate securement of the switch to a selected structure. Three terminals 7 extend rearward from an end 10 of the switch opposite the plunger 3.

The actuating mechanism 1 includes housing means such as housing 20 for securing the switch 2 therein. The housing 20 is preferably formed from a relatively hard, rigid material such as a hard plastic. The housing 20 includes an upper surface 21 and a lower surface 22. As is best seen in FIGS. 3 and 4, the distance between the upper surface 21 and the lower surface 22 of the housing 20 is preferably only slightly greater than the thickness of the switch 2. A switch receiving cavity 23 is formed in the housing 20 and extends from the lower surface 22 toward the upper surface 21 thereof. The switch 2 is securable within the switch receiving cavity 23 on posts 24 formed in the housing 20 and extending into the securement holes 5 of the switch 2. The switch 2 is secured in the cavity 23 such that the axis of the plunger 3 extends in parallel relation with the upper and lower surfaces 21 and 22 of the switch 2.

A spring receiving opening or hole 25 extends through the housing 20 from the upper surface 21 to the lower surface 22 with a diameter of the hole 25 aligned with the axis of the plunger 3. A spring receiving channel or slot 27 is formed in and extends into the housing 20 from the lower surface 22 toward the upper surface 21. The spring receiving slot 30 is preferably rectangular and extends across the spring receiving hole 25 coaxially with the axis of the plunger 3. A first end 31 of the slot 30 connects to and opens into the switch receiving cavity 23 such that the plunger 3 extends into the slot 30. In addition, the slot 30, near its first end 31 does not extend completely through the housing 20 such that a portion of the housing 20 extends over the slot 30 at the slot first end 31 to form a first overhang 32. Similarly, the slot 30, near a second end 33 thereof, does not extend completely through the housing 20 such that a portion of the housing 20 extends over the slot 30 at the slot second end 33 to form a second overhang 34.

A wiring channel 40 is also formed in the housing 20 so as to extend from the lower surface 22 and toward but not completely to the upper surface 21 of the housing 20. A first end of the channel 40 opens into the switch receiving cavity 23 at an end of the cavity 23 at which the terminals 7 are positioned. The channel 40, at a second end thereof, extends out a side 43 of the housing 20. Electrical wiring 45 is securable to the terminals 7 and extendable through the channel 40. The side of the housing 20 to which the electrical wiring 45 needs to be routed may vary depending on the particular application sought and therefore the routing of the channel 40 may vary.

A sealant injection hole 47 extends through the housing 20 from the upper surface 21 to the lower surface 22 and is flow connected to the wiring channel 40 by a distribution channel 48. The distribution channel 48 extends into the housing 20 from the bottom surface 22 toward the upper surface 21. A waterproof or water resistant sealing compound or potting compound 49 may be injected into the wiring channel 40 through the injection hole 47 and distribution channel 48 to form a water-tight seal around the wiring 45. It is foreseen that the sealant injection hole 47 could be routed through the side or edge of the housing 20, or that the potting compound could be injected directly into the channel 40 through the open end on the side 43 of the housing 20.

A spring 50 preferably formed from a bowed length of spring steel (sometimes referred to as a flat-spring or leaf spring) is secured within the spring receiving hole 25 and slot 30. The spring 50 includes a first spring end 51, a second spring end 52 and a middle portion 53. In its resting state, the spring 50 is bowed. A first glide or shoe 59 is positioned on the first spring end 51 and a second glide or shoe 60 is positioned on the second spring end 52.

Each glide 59 and 60 includes a front face 61, a rear 62, an upper surface 63, sidewalls 64 and 65 and a bottom surface 66. A notch or groove 68 extends into each glide 59 and 60 from the rear 62 thereof from sidewall 64 to sidewall 65 and is sized and shaped for receiving the first or second spring end 51 or 52 of spring 50. A rearward projecting overhang or upper flange 70 is formed in the glides 59 and 60 above the notch 68 and a rearward projecting tail or lower flange 71 is formed in the glides 59 and 60 below the notch 68. The upper flange 70 is preferably shorter than the lower flange 71 and includes a beveled face 72 on its lower, outer corner to accommodate the bow of the spring 50. The glides 59 and 60 are preferably formed from material exhibiting a relatively low coefficient of friction, such as plastic resin sold under the trademark Delrin.

The switch 2, spring 50, glides 59 and 60 and wiring 45 are held within the housing 20 by a backing or backing sheet 75. The backing 75 is formed from a layer of relatively thin material, such as a relatively rigid polyester plastic sheet. The relative thickness of the backing sheet 75 shown in the drawings is exaggerated to make the backing sheet 75 readily discernable. The backing 75 is secured to the lower surface 22 of the housing 20 by securement means such as an adhesive. The backing 75 extends across the switch receiving cavity 23, the spring receiving opening 25 and slot 30 and the wiring channel 40 and secures the switch 2, the spring 50, the glides 59 and 60 and the electrical wiring 45 respectively therein. The glides 59 and 60 slide across the backing sheet 75 upon compression and subsequent release of the spring 50 as discussed in more detail below. Adhesive is selectively omitted from the backing 75 in the area in which the glides 59 and 60 will slide across the backing 75 to ensure proper functioning of the actuating mechanism 1. The potting compound 49 is typically injected into the wiring channel 40 through the injection hole 47 and distribution channel 48 after the backing sheet 75 is secured to the housing 20.

The spring 50 is positioned within the hole 25 and slot 30 of the housing 20 in the resting state, such that the middle portion 53 of the spring 50 extends through the hole 25 and bows above the upper surface 21 of the housing 20. The spring 50 is sized such that when it is positioned in the slot 30 the front face 61 of glide 59 on the first spring end 51 is positioned in closely spaced relation to the end of the plunger 3 positioned in the extended position and the front face 61 of glide 60 on the second spring end 52 is positioned in closely spaced relation to an inner wall 78 of the housing 20 at the slot second end 33. The phrase "in closely spaced relation" is intended to mean in actual engagement or positioned slightly apart. In addition, when the spring 50 is positioned within the slot 30, the first glide 59 is generally positioned beneath the first overhang 32 and the second glide 60 is generally positioned beneath the second overhang 34. The distance between the inner surface of the backing 75 and the inner surface of the first and second overhangs 32 and 34 is just slightly greater than the thickness of the glides 59 and 60 such that the glides 59 and 60 are allowed to slide therebetween without binding.

A set screw 80 is threaded into a threaded bore 81 formed in the housing 20 and extending from an end 83 of the housing 20 to the second end 33 of spring receiving slot 30, through inner wall 78. The inner end of the set screw 80 may be advanced past the inner wall 78 and into the spring receiving slot 30 a selected distance to reduce the effective length of the spring receiving slot 30, thereby reducing the required distance to be traveled by the first glide 59 to depress the plunger 3. When the inner end of the set screw 80 is extended through inner wall 78 and into spring receiving slot 30, the front face 61 of second glide 60 engages the set screw 80, at least when the spring 50 is depressed. Prior to depression of the spring 50 the front face 61 of second glide 60 is positioned in closely spaced relation with the inner end of the set screw 80. A thread sealing compound is preferably applied to the set screw 80 prior to threading the set screw 80 into the threaded bore 81 to form a water tight seal between the set screw 80 and threaded bore 81.

As is best seen in FIG. 4, application of a force to the middle portion 53 of the spring 50 and toward the upper surface 21 of the housing 20 compresses the spring 50 such that the first glide 59 on first spring end 51 advances further away from the second glide 60 on second spring end 52 and toward the switch 2 a distance sufficient to drive or move the plunger 3 to the retracted position. The spring 50 thereby translates a force applied perpendicularly to the axis of the plunger 3, to a force applied coaxially with the plunger. As the spring 50 is compressed, the first and second spring ends 51 and 52 are driven into a front lower corner in the groove or notch 68 in the respective glide 59 and 60.

Removal of the force applied to the middle portion 53 of the spring 50 allows the spring 50 to return to the resting state such that the first spring end 51 and attached glide advance away from the switch a distance sufficient to allow the plunger 3 to advance back to the extended position. Although the glides 59 and 60 are generally only loosely connected to the first and second spring ends 51 and 52, the downwardly and inwardly directed force exerted by the spring ends 51 and 52 on the rearwardly projecting lower flange 71 of the respective glide 59 and 60 may be sufficient to pull the glides 59 and 60 away from the switch plunger 3 and set screw 80 respectively. It is also foreseen that the first glide 59 may only retract the distance that it is pushed rearward by the plunger 3 once the force is removed from the middle portion 53 of spring 50 and the spring ends 51 and 52 will then slide rearward along the upper surface of the associated lower flange 71 of each glide 59 and 60. The lower flange 71 of each glide 59 and 60 is sufficiently long and the distance between the opposed lower flanges 71 when the glides 59 and 60 are separated their furthest distance apart is sufficiently small to prevent either spring end 51 or 52 from sliding off of either of the associated lower flanges 71 when the spring advances to the resting, uncompressed position. It is also to be understood that the glides 59 and 60 could be fixedly secured to the spring ends 51 and 52 by a wide variety of means including adhesives or mechanical connections.

A flexible seal or sealing member 85 is mounted on the upper surface 21 of the housing 20 over the spring 50 and the spring receiving hole 25. The flexible seal 85 preferably is dome shaped or hemispherical with a peripheral flange 87 for securing the seal 85 to the housing 20 in a seal receiving recess 89 formed in the upper surface 21 of the housing. The seal receiving recess is formed around the periphery of the spring receiving hole 25 and the depth of the recess 89 generally corresponds to the thickness of the peripheral flange 87 so that the upper surface of the flange 87 extends flush with the upper surface 21 of the housing 20. The flexible seal may be formed from a polyurethane, thermoset film approximately 5 to 10 mils thick. The flange 87 of seal 85 may be secured to the housing by a urethane pressure sensitive adhesive. A circular, flattened area 91 may be formed in the seal 85 around its apex.

The limit switch actuating mechanism 1 is securable to various structures by securement means such as adhesives or bolting. The housing 20 includes bores 92 through which screws or bolts may be driven for securing the housing 20 to a structure.

FIGS. 3 and 4 is representative of one use of the actuating mechanism 1 of the present invention in an injection molding application, which is described in more detail in U.S. Pat. No. 5,446,252. Referring to FIGS. 3 and 4 of the present application, the reference numeral 93 is representative of an ejector plate advanceable between an ejecting position and a retracted position by means not shown. In the retracted position, a lower surface 94 of the ejector plate 93 engages rest buttons 95 (one of which is shown in FIGS. 3 and 4) positioned on and extending slightly above an inner surface 96 of an ejector housing 97.

In the representative application of the actuating mechanism 1 as shown in FIGS. 3 and 4, the actuating mechanism 1, is used to verify that the ejector plate 93 has returned to the retracted position. Due to its relatively narrow profile, the limit switch actuating mechanism 1 of the present invention may be secured within the ejector housing 97 by bolting the actuating mechanism 1 to the inner surface 96 thereof. The actuating mechanism 1 is sized such that the upper surface 21 of the actuator mechanism housing 20 is generally flush with the upper surfaces of the rest buttons 95 and the middle portion 53 of the spring 50, when not engaged, extends above the upper surface 21 of the housing 20 and the upper surfaces of the rest buttons 95. As the ejector plate 93 is advanced to a retracted position, the lower surface 94 of the ejector plate 93 engages the seal 85 and compresses the spring 50, advancing the first spring end 51 and first glide 59 toward the switch 50, moving the plunger 3 to the retracted position so as to change the condition of the switch 50 from an open condition to a closed condition or vice versa and send a signal indicating that the ejector plate 93 has returned to the retracted position.

As the seal 85 and spring 50 are compressed by advancement of the ejector plate 93 to the retracted position, the excess material of the seal 85 is forced into the spring receiving hole 25. The spherical shape of the seal 85 and the round shape of the spring receiving hole 25 generally provide a relatively large area for receiving or taking up the excess material of the seal 85 as it is forced downward or inward by the retracting ejector plate 93. The flattened area 91 on seal 85 is also believed to reduce the amount of excess material created when the seal 85 is generally flattened by retraction of the ejector plate 93. The spherical shape of the seal 85 is also believed to result in less stress to the polyurethane material, increasing the life of the seal.

The flexible seal 85, the potting compound 49 injected around the wiring 45 and the sealing compound applied to the set screw 80 function to form a water tight or liquid resistant seal around the plunger type switch 2 and the electrical connections between the switch 2 and wiring 45 including around the terminals 7. The water resistant actuating mechanism 1 is particularly adapted for use in applications in which the actuating mechanism may be routinely exposed to water or other liquids.

It is foreseen that the actuating mechanism 1 of the present invention has numerous applications beyond the injection molding application discussed above and its use is not intended to be limited to such applications.

It is also foreseen that the spring 50 could be sized and positioned in the slot 30 such that in the resting state the first spring end 51 holds the plunger 3 in the retracted position and the application of a force to the middle portion 53 of the spring 50 to cause the spring to bow advances the first spring end 51 away from the switch 2 a distance sufficient to allow the plunger 3 to move to the extended position. Release of the force, then allows the spring 50 to advance back to the resting position so as to allow the first spring end 51 to advance toward the switch 2 thereby moving the plunger 3 to the retracted position.

It is to be understood that while certain forms of the present invention have been illustrated and described herein, it is not to be limited to the specific forms or arrangement of parts described and shown.

What is claimed is:

1. An actuating mechanism for a plunger-type switch having alternative open and closed conditions and having a plunger moveable between an extended position and a retracted position whereby said switch condition is changed by the movement of the plunger; said actuating mechanism comprising:

a) a housing having an upper surface; said housing being adapted to receive a plunger-type switch;

b) a spring having a first spring end, a second spring end and a middle portion; said spring being positioned within said housing such that said first spring end is positioned in closely spaced relation to the plunger of a plunger-type switch received within said housing with the plunger in the extended position; said middle portion of said spring bowing above said housing upper surface through a spring receiving hole in said housing such that the application of a force to said middle portion of said spring and directed toward said housing upper surface compresses said spring, advancing said first spring end toward the switch received within said housing a distance sufficient to move the switch plunger to the retracted position and upon removal of the force said first spring end advances away from the switch a distance sufficient to allow the switch plunger to move to the extended position; and c) a flexible sealing member secured to said housing upper surface and extending over said spring and enclosing said spring receiving hole.

2. The actuating mechanism as in claim 1 wherein said flexible sealing member is generally dome shaped.

3. The actuating mechanism as in claim 1 in combination with a plunger type switch having alternative open and close conditions and having a plunger movable between an extended position and a retracted position whereby said switch condition is change by the movement of said plunger.

4. The combination as in claim 3 and further comprising a backing secured to and extending at least partially across a lower surface of said housing to cover said spring and said switch.

5. The combination as in claim 4 and further including a first glide positioned on said first spring end, said first glide having a bottom surface slidably engaged with said backing and a front face in closely spaced relation to the switch plunger when the plunger is in the extended position.

6. The combination as in claim 5 wherein said first spring end is received in a groove in a rear of said first glide.

7. The combination as in claim 6 wherein said rear of said first glide includes an upper overhanging wall above said groove and a rearwardly projecting lower wall below said groove, said upper overhanging wall being shorter than said rearwardly projecting lower wall.

8. The combination as in claim 5 and further including a second glide positioned on said second spring end, said second glide having a bottom surface slidably engaged with said backing and a front face in closely spaced relation to an inner wall of said housing.

9. The combination as in claim 8 wherein said second spring end is received in a groove in a rear of said second glide.

10. The combination as in claim 9 wherein said rear of said second glide includes an upper overhanging wall above said groove and a rearwardly projecting lower wall below said groove, said upper overhanging wall being shorter than said rearwardly projecting lower wall.

11. The combination as in claim 3 wherein:

a) a cavity is formed in said housing for receiving said switch;

b) a channel extends into the housing from a lower surface thereof for receiving electrical wiring connectable to terminals on said switch; said channel extending from said cavity to a side opening in as side of said housing;

c) a backing is secured to and extends at least partially across said housing lower surface to cover said spring receiving hole, said cavity and said channel;

d) potting compound forms a seal around said electrical wiring to seal a connection between said electrical wiring and said terminals from the ingress of liquid through said side opening.

12. The combination as in claim 11 and further comprising an inlet opening extending into said housing from said upper surface thereof and in flow communication with said channel, said inlet opening sized for injecting potting compound therethrough and into said wiring channel.

13. A limit switch assembly comprising:

a) a plunger-type switch having alternative open and closed conditions and having a plunger moveable between an extended position and a retracted position whereby said switch condition is changed by the movement of the plunger;

b) a housing having said switch positioned therein, a spring receiving hole extending into said housing from an upper surface thereof and a spring receiving slot formed in said housing and across said spring receiving hole with a first end of said slot extending adjacent said plunger of said switch and a second end of said slot being closed by an inner wall of said housing;

c) a spring positioned in said spring receiving slot, said spring having a first spring end, a second spring end and a middle portion; said first spring end being received in said first end of said slot, said middle portion of said spring bowing upwardly through said spring receiving hole above said housing upper surface of said housing and said second spring end being positioned in said second end of said slot;

d) a first glide positioned on said first spring end and slidably positioned within said first end of said slot, said first glide having a front face, opposed sidewalls, a top, a bottom and a rear, said front face being in closely spaced relation to the switch plunger when the plunger is in the extended position; said rear having a groove formed therein, an upper overhanging wall above said groove and a rearwardly projecting lower wall below said groove, said upper overhanging wall being shorter than said rearwardly projecting lower wall, and said groove being sized to receive said first spring end for connecting said first glide to said first spring end; wherein e) said spring is compressible through the application of a force to said middle portion of said spring and directed toward said housing upper surface to advance said first glide toward said switch plunger advancing the plunger to the retracted position.

14. The limit switch assembly as in claim 13 and further including a second glide positioned on said second spring end, said second glide having a front face, opposed sidewalls, a top, a bottom and a rear, said front face being in closely spaced relation to said inner wall of said housing; said rear having a groove formed therein, an upper overhanging wall above said groove and a rearwardly projecting lower wall below said groove, said upper overhanging wall being shorter than said rearwardly projecting lower wall, and said groove being sized to receive said second spring end for connecting said second glide to said first second end.

15. The limit switch assembly as in claim 13 and further comprising a flexible sealing member secured to said housing upper surface and extending over said spring and enclosing said spring receiving hole.

16. The limit switch assembly as in claim 15 wherein:

a) a channel extends through said housing for receiving electrical wiring connectable to terminals on said switch; said channel extending from said switch receiving cavity to a side opening in said housing;

b) a sealing compound forms a watertight seal around said electrical wiring to seal a connection between said electrical wiring and said terminals.

17. A limit switch assembly comprising:

a) a plunger-type switch having alternative open and closed conditions and having a plunger moveable between an extended position and a retracted position whereby said switch condition is changed by the movement of the plunger;

b) a housing having a switch cavity with said plunger-type switch positioned therein, a spring receiving hole extending into said housing from an upper surface thereof and a spring receiving slot formed in said housing and across said spring receiving hole with a first end of said slot extending beneath an overhang in said housing and opening into and extending adjacent said switch cavity, whereby the plunger-type switch received in the switch cavity is positioned generally adjacent a first end of said slot such that the switch plunger extends into said slot when the plunger is in the extended position;

c) a spring having a first spring end, a second spring end and a middle portion; a first glide is positioned on said first spring end and slidably positioned within said first end of said slot in closely spaced relation to the switch plunger when the plunger is in the extended position; said middle portion of said spring bows above said housing upper surface and said second spring end is positioned in closely spaced relation to said housing at a second end of said slot; said spring being compressible through the application of a force to said middle portion of said spring and directed toward said housing upper surface to advance said first spring end and said first glide toward said switch plunger advancing the plunger to the retracted position and upon removal of the force said first glide and said first spring end advance away from said switch plunger allowing the switch plunger to move to said extended position;

d) said first glide having a front face, opposed sidewalls, a top, a bottom and a rear; a groove is formed in said rear of said first glide between an upper overhanging wall and a rearwardly projecting lower wall, wherein said upper overhanging wall is shorter than said rearwardly projecting lower wall and said groove is sized to receive the first spring end for connecting said first glide to said first spring end.

18. The limit switch assembly as in claim 17 and further comprising a flexible sealing member secured to said housing upper surface and extending over said spring and enclosing said spring receiving hole.

19. The limit switch assembly as in claim 17 wherein:

a) a channel extends through said housing for receiving electrical wiring connectable to terminals on said switch; said channel extending from said switch receiving cavity to a side opening in said housing;

b) a sealing compound forms a watertight seal around said electrical wiring to seal a connection between said electrical wiring and said terminals.

20. The actuating mechanism as in claim 17 and further comprising an inlet opening extending into said housing in flow communication with said channel, said inlet opening sized for injecting a sealing compound therethrough and into said wiring channel.

* * * * *